US008290418B2

(12) United States Patent
Kim et al.

(10) Patent No.: US 8,290,418 B2
(45) Date of Patent: Oct. 16, 2012

(54) HEATING MEMBER USING CARBON NANOTUBE AND FIXING UNIT USING THE HEATING MEMBER

(75) Inventors: Ha-jin Kim, Suwon-si (KR); In-taek Han, Seoul (KR); Sang-soo Jee, Kimpo-si (KR); Sang-eui Lee, Yongin-si (KR); Dong-earn Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 488 days.

(21) Appl. No.: 12/557,783

(22) Filed: Sep. 11, 2009

(65) Prior Publication Data

US 2010/0209154 A1 Aug. 19, 2010

(30) Foreign Application Priority Data

Feb. 19, 2009 (KR) ..... 10-2009-0013999

(51) Int. Cl.
*G03G 15/20* (2006.01)

(52) U.S. Cl. ..... 399/333; 399/122; 399/167

(58) Field of Classification Search ..... 399/167, 399/122

See application file for complete search history.

(56) References Cited

U.S. PATENT DOCUMENTS

| | | | | |
|---|---|---|---|---|
| 4,820,904 | A | 4/1989 | Urban | |
| 5,932,125 | A | 8/1999 | Kawata et al. | |
| 6,063,463 | A | 5/2000 | Schlueter, Jr. et al. | |
| 6,122,480 | A | 9/2000 | Hwang | |
| 2006/0002737 | A1 * | 1/2006 | Shinshi | 399/122 |
| 2008/0219729 | A1 | 9/2008 | Matsunaka et al. | |
| 2008/0232853 | A1 | 9/2008 | Law | |
| 2009/0123185 | A1 * | 5/2009 | Lin et al. | 399/176 |
| 2009/0257796 | A1 * | 10/2009 | Colvin et al. | 399/336 |

FOREIGN PATENT DOCUMENTS

| | | | |
|---|---|---|---|
| JP | 05-278141 | A | 10/1993 |
| JP | 2005-292218 | A | 10/2005 |
| JP | 2008-020561 | A | 1/2008 |
| JP | 2008-197585 | A | 8/2008 |

OTHER PUBLICATIONS

Ei-ichi Yasuda et al. Carbon Alloy: novel concpets to develop carbon science and technology, Gulf Professional Publishing, 2003, p. 50.*

* cited by examiner

*Primary Examiner* — Walter L Lindsay, Jr.
*Assistant Examiner* — Roy Y Yi
(74) *Attorney, Agent, or Firm* — Cantor Colburn LLP

(57) ABSTRACT

A fixing unit includes a heating member which includes a core member, and a heating layer. The heating layer is disposed on an outer circumference of the core member. The heating layer includes an elastic material, and carbon nanotube doped with metal and distributed in the elastic material as a conductive filler of the heating layer. A press member faces the heating member to form a fixing nip. The fixing unit applies heat and pressure to toner on a medium passing through the fixing nip, to fix the toner on the medium.

14 Claims, 4 Drawing Sheets

HEATING MEMBER USING CARBON NANOTUBE AND FIXING UNIT USING THE HEATING MEMBER

CROSS-REFERENCE TO RELATED APPLICATIONS

This application claims priority to Korean Patent Application No. 10-2009-0013999, filed on Feb. 19, 2009, and all the benefits accruing therefrom under 35 U.S.C. §119, the disclosure of which is incorporated herein in its entirety by reference.

BACKGROUND

1. Field

One or more embodiments relate to a heating member using a carbon nanotube as a conductive filler and a fixing unit which fixes toner on paper using the heating member.

2. Description of the Related Art

In an electrophotographic image forming apparatus, toner is provided to an electrostatic latent image formed on an image receiving medium, to form a visible toner image on the image receiving medium. The toner image is transferred to paper and a transferred toner image is fixed on the paper. The toner is manufactured by adding various functional additives, including a coloring agent, to base resin. In the fixing process, heat and pressure are applied to the toner. A considerable portion of energy used in the electrophotographic image forming apparatus is consumed in the fixing process.

In general, a fixing unit includes a heating roller and a press roller which are engaged with each other to form a fixing nip. The heating roller is heated by a heat source, such as a halogen lamp. Heat and pressure are applied to the toner while the paper, to which the toner is transferred, passes through the fixing nip. In the fixing unit, since the heat source applies heat to the heating roller, and the heat is transferred to the toner via the paper, it may be difficult to expect high thermal transfer efficiency. Also, since the heat capacity of the heating roller, that is, an object to be heated, is high, the fixing unit has a disadvantage in the heat-up of the heating roller is relatively slow.

To overcome the above matter, a fixing unit having a surface type heating body using a thermal wire provided at the outer circumference of the heating roller has been suggested. The surface type heating body is advantageous in the fast heat-up, but disadvantageous in the uniform heating of the overall surface type heating body. That is, a portion of the heating body close to the thermal wire may be locally overheated.

SUMMARY

One or more embodiments include a heating member capable of fast and uniform heat-up and a fixing unit for fixing toner using the heating member.

One or more embodiments includes a heating member including a core member, and a heating layer disposed at an outer circumference of the core member. The heating layer includes an elastic material and carbon nanotube doped with metal and distributed in the elastic material as a conductive filler.

One or more embodiments includes a fixing unit including a heating member and a press member facing the heating member to form a fixing nip. The heating member includes a core member, and a heating layer disposed at an outer circumference of the core member. The heating layer includes an elastic material and carbon nanotube doped with metal and distributed in the elastic material as a conductive filler. The fixing unit applies heat and pressure to toner on a medium passing through the fixing nip to fix the toner on the medium.

One or more embodiments includes an electrophotographic image forming apparatus including a fixing unit receiving a medium including a toner image disposed thereon, and fixing the toner image to the medium. The fixing unit includes a press member and a heating member facing the press member, and forming a fixing nip with the press member. The heating member includes a core member and a heating layer disposed on an outer surface of the core member, and between the outer surface of the core member and an outermost surface of the heating member. The heating layer includes an elastic material and carbon nanotube doped with metal and distributed in the elastic material as a conductive filler of the heating layer. The fixing unit applies heat and pressure to the toner image disposed on the medium, as the medium including the toner image passes through the fixing nip, and fixes the toner image to the medium.

An aspect ratio length to diameter of the carbon nanotube may be not less than 5000:1.

A content of the carbon nanotube in the heating layer may be less than 1 part by weight.

The carbon nanotube may be distributed in an outer surface layer of the heating layer.

The heating member may further include a heat insulation layer that is located between the core member and the heating layer.

The core member may have a metal hollow pipe shape.

The core member may have a flexible belt shape.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
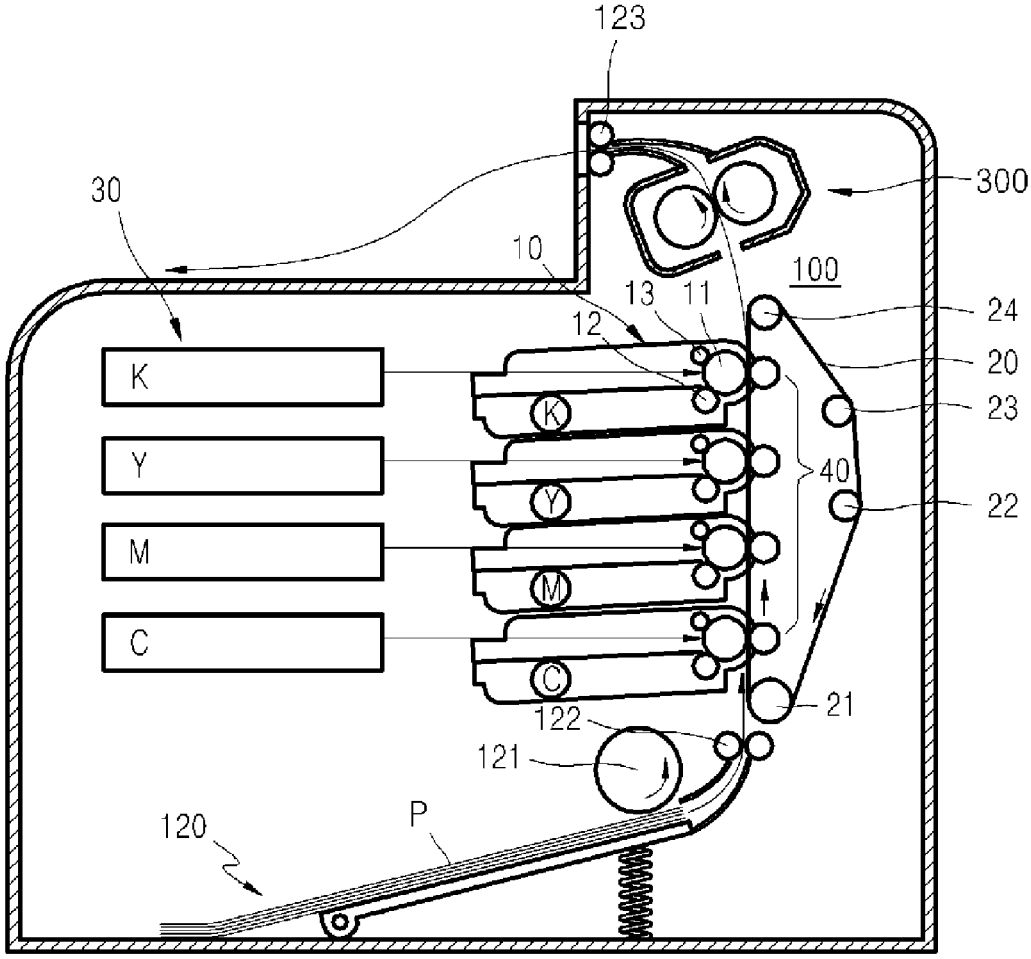
FIG. 1 illustrates an exemplary embodiment of an electrophotographic image forming apparatus according to the invention.

Reference will now be made in detail to embodiments, examples of which are illustrated in the accompanying drawings, wherein like reference numerals refer to the like elements throughout. In this regard, the exemplary embodiments may have different forms and should not be construed as being limited to the descriptions set forth herein. Accordingly, the embodiments are merely described below, by referring to the figures, to explain aspects of the invention. In the drawings, the size and relative sizes of layers and regions may be exaggerated for clarity.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be described in detail with reference to the accompanying drawings.

FIG. 1 illustrates an exemplary embodiment of an electrophotographic image forming apparatus using a fixing member and a fixing unit according to the invention. Referring to FIG. 1, the electrophotographic image forming apparatus includes a printing unit 100 for printing an image on a printing medium, such as paper, in an electrophotographic process, and a fixing unit 300. The image forming apparatus of FIG. 1 is an exemplary embodiment of a dry electrophotographic image forming apparatus that prints a color image using a dry developer (hereinafter, referred to as the toner).

The printing unit 100 includes an exposing unit 30, a developing unit 10, and a transfer unit. To print a color image, the printing unit 100 of the illustrated embodiment includes four developing units 10C, 10M, 10Y, and 10K, respectively, containing toner having different colors, for example, cyan ("C"), magenta ("M"), yellow ("Y"), and black ("K"), and four exposing units 30C, 30M, 30Y, and 30K, respectively, corresponding to the developing units 10C, 10M, 10Y, and 10K.

Each of the developing units 10C, 10M, 10Y, and 10K includes a photosensitive drum 11 that is an image receiving medium, on which an electrostatic latent image is formed, and a developing roller 12 for developing the electrostatic latent image. A charge bias is applied to a charge roller 13 to charge an outer circumference of the photosensitive drum 11 to a uniform electric potential. In an alternative embodiment, a corona discharger (not shown) may be used instead of the charge roller 13. The developing roller 12 supplies toner to the photosensitive drum 11 by allowing the toner to adhere to the outer circumference of the developing roller 12.

In an exemplary embodiment, each of the developing units 10C, 10M, 10Y, and 10K may further include a supply roller (not shown) allowing the toner contained in each of the developing units 10C, 10M, 10Y, and 10K to adhere to the developing roller 12, a restriction unit (not shown) restricting the amount of the toner adhering to the developing roller 12, and/or an agitator (not shown) transferring the toner contained in each of the developing units 10C, 10M, 10Y, and 10K to the supply roller and/or the developing roller 12. Also, each of the developing units 10C, 10M, 10Y, and 10K may further include a cleaning blade (not shown) removing excess or unneeded toner adhering to the outer circumference of the photosensitive drum 11 prior to the charging, and an accommodation space or collector (not shown) for accommodating the removed toner.

Referring again to the embodiment illustrated in FIG. 1, the transfer unit may include a paper transfer belt 20 and a plurality of a transfer roller 40, such as four corresponding to the number of developing units 10. A portion of the paper transfer belt 20 is arranged to face a portion of the outer circumferential surface of the photosensitive drum 11 that is exposed to the outside of the developing units 10C, 10M, 10Y, and 10K.

The paper transfer belt 20 circulates by being supported by and moved by a plurality of rotating support rollers 21, 22, 23, and 24. The paper transfer belt 20 according to the illustrated embodiment is vertically installed. Each of the transfer rollers 40 is arranged to face the photosensitive drum 11 of one of each of the developing units 10C, 10M, 10Y, and 10K, with the paper transfer belt 20 interposed therebetween. A transfer bias is applied to each of the transfer rollers 40.

Each of the exposing units 30C, 30M, 30Y, and 30K scans a light beam corresponding to image information of cyan ("C"), magenta ("M"), yellow ("Y"), and black ("K") onto the photosensitive drum 11 of each of the developing units 10C, 10M, 10Y, and 10K. Such a light beam is shown in FIG. 1 as an arrow from each of the exposing units 30C, 30M, 30Y, and 30K to a corresponding photosensitive drum 11 of each of the developing units 10C, 10M, 10Y, and 10K, respectively. In the illustrated embodiment, a laser scanning unit ("LSU") using a laser diode as a light source, is employed as the exposing units 30C, 30M, 30Y, and 30K.

In an exemplary embodiment of a color image forming process employing the electrophotographic image forming apparatus configured as described above, the photosensitive drum 11 of each of the developing units 10C, 10M, 10Y, and 10K is charged to a uniform electric potential by the charge bias applied to the charge roller 13. Each of the exposing units 30C, 30M, 30Y, and 30K scans a light beam corresponding to the image information of cyan ("C"), magenta ("M"), yellow ("Y"), and black ("K") onto the photosensitive drum 11 of each of the developing units 10C, 10M, 10Y, and 10K, to form an electrostatic latent image. A development bias is applied to the developing roller 12. The toner adhering to the outer circumference of the developing roller 12 adheres to the electrostatic latent image on the photosensitive drum 11 so that toner images of cyan ("C"), magenta ("M"), yellow ("Y"), and black ("K") may be respectively formed on the photosensitive drums 11 of the developing units 10C, 10M, 10Y, and 10K.

The medium that finally accommodates the toner, for example, paper P, is ejected from a cassette 120 by a pickup roller 121. The paper P is transferred to the paper transfer belt 20 by a transfer roller 122. The paper P adheres to the surface of the paper transfer belt 20 due to an electrostatic force and is transferred at the same velocity as the running linear velocity of the paper transfer belt 20.

In one exemplary embodiment, a leading end of the paper P arrives at a transfer nip at substantially a same time as when the leading end of a toner image of cyan ("C") formed on the outer circumferential surface of the photosensitive drum 11 of the developing unit 10C arrives at the transfer nip facing the transfer roller 40. When the transfer bias is applied to the transfer roller 40, the toner image formed on the photosensitive drum 11 is transferred to the paper P.

The leading end of the paper P and the paper P itself, is transferred to be aligned with each of the developing units 10C, 10M, 10Y, and 10K. As the paper P is transferred to the developing units 10C, 10M, 10Y, and 10K, the toner images of cyan ("C"), magenta ("M"), yellow ("Y"), and black ("K") formed on the photosensitive drums 11 of the developing units 10C, 10M, 10Y, and 10K are sequentially transferred to the paper P to overlap with one another, respectively. Accordingly, a multi-color toner image is formed on the paper P.

The color toner image transferred to the paper P is maintained on a surface of the paper P due to an electrostatic force. The fixing unit 300 further fixes the color toner image on the paper P using heat and pressure. The paper P that completes the fixing process is ejected out of the image forming apparatus by an eject roller 123.

To form an image employing an electrophotographic image forming apparatus, a fixing unit is heated to a temperature close to a predetermined fixing temperature. As the time for heating decreases, the time for printing the first page after a print command is received decreases as well. In a conventional electrophotographic image forming apparatus, the fixing unit is heated only when printing is carried out, but is not heated in a ready mode. However, to restart the printing, time is consumed to reheat the fixing unit to restart printing and forming the image.

To reduce the time consumed to restart the printing, the fixing unit is controlled to maintain a preheat temperature during the ready mode. A preheat temperature in the ready mode may be about 150 degrees Celcius (° C.) to about 180 degrees Celcius (° C.). In an image forming apparatus to print an image on an A4 sized paper, an amount of consumed power may be, for example, about 30 watt. If a heat-up time to increase the temperature of the fixing unit to a temperature at which printing may be performed is decreased, the preheat during the ready mode may be reduced or may not needed so that the energy consumed by the fixing unit may be reduced.

Figure 2:
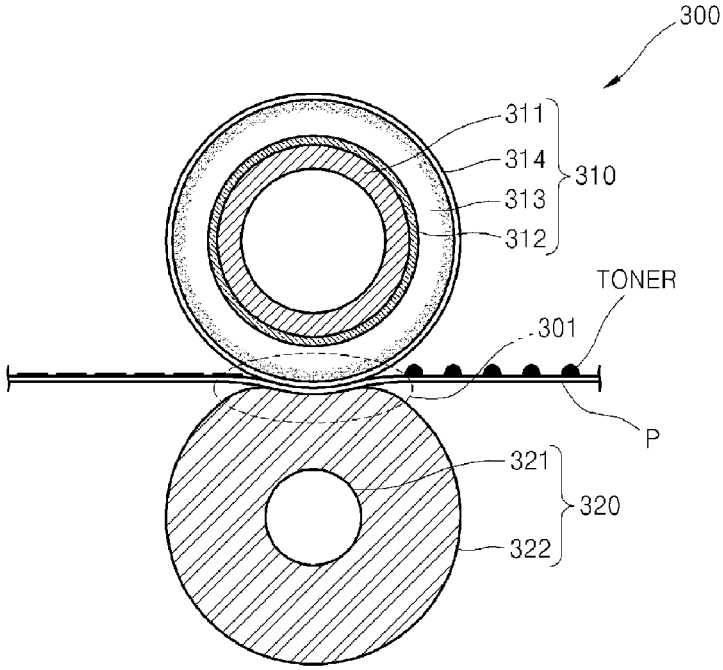
FIG. 2 is a cross-sectional view of a fixing unit using a roller type fixing member in the electrophotographic image forming apparatus according to the invention.

FIG. 2 is a cross-sectional view of the fixing unit 300 of FIG. 1. Referring to FIG. 2, the fixing unit 300 includes a heating member 310 of a cylindrical roller shape, and a press member 320 engaged with the heating member 310 to collectively form a fixing nip 301. The fixing nip 301 is indicated by the dotted line circle in FIG. 2. The term "nip" is used to indicate a location or point where a surface of the heating member 310 and a surface of the press member 320 squeeze or compress tightly the paper P, such as to pinch the paper P between the two surfaces.

In one exemplary embodiment, the press member 320 has a cylindrical roller shape in which an elastic layer 322 is disposed on a core member 321 which may include metal. The heating member 310 and the press member 320 are biased in directions to be engaged with each other by a bias member, for example, a spring, that is not illustrated in the drawing. As the elastic layer 322 of the press member 320 is partially deformed, such as when the press member 320 contacts the heating member 310, the fixing nip 301 is formed in which thermal transfer from the heating member 310 to the toner on the paper P is made.

The heating member 310 includes a core member 311 and a heating layer 313 disposed around an outer circumference of the core member 311. In the illustrated embodiment, where a metal hollow pipe is used as the core member 311, the heating member 310 has an overall cylindrical roller shape. When the heating member 310 configured as above is applied to the fixing unit of an electrophotographic image forming apparatus, the heating member 310 may be referred to as a fixing roller.

The heating layer 313 may be provided as the outermost surface of the heating member 310, such as being directly adjacent to an outermost circumference of the heating member 310. Alternatively, an outer boundary of the heating layer 313 may be disposed a distance from the outermost surface of the heating member 310, such that the heating layer 313 is disposed adjacent to the outermost circumference of the heating member 310. An inner boundary of the heating layer 313 is disposed separated from the core member 311 and/or separated from the outermost surface of the heating member 310, such that an area of the heating member 310 that is actually heated is disposed closer to (e.g., adjacent to) the outermost surface of the heating member 310 than to the core member 311, or to a center of the heating member 310. The heating layer 313 is a single unitary continuous and indivisible member.

The heating layer 313 may be formed by distributing conductive filler in an elastic material. Any of a number of materials exhibiting elasticity and a heat resistant characteristic to endure a fixing temperature, may be used as the elastic material of the heating layer 313. In one exemplary embodiment, high heat-resistant elastomer, such as silicon rubber of polydimethylsiloxane ("PDMS") may be used as the elastic material of the heating layer 313.

When power (e.g., electrical) is supplied to the heating layer 313, heat is generated due to the resistance of the conductive filler. In the illustrated embodiment, a carbon nanotube is used as the conductive filler. The carbon nanotube may include a conductive material or a resistant material having conductivity of about $10^{-4}$ siemen per meter (S/m) to about 100 siemens per meter (S/m), according to the content thereof.

As shown in Table 1, since the carbon nanotube has a conductivity substantially equivalent to metal and a very low density, a heat capacity per unit volume (heat capacity=density×specific heat) is lower, by three to four times, than that of a general resistant material. This means that the temperature of the heating layer 313 using the carbon nanotube as a conductive filler may be changed very quickly.

TABLE 1

| Resistant Material | Density ($g/cm^3$) | Specific Resistance (Ωcm) | Thermal Conductivity (W/m · K) | Specific Heat (J/Kg · K) |
|---|---|---|---|---|
| $Al_2O_3$ | 3.97 | $>10^{14}$ | 36 | 765 |
| Aln | 3.26 | $>10^{14}$ | 140~180 | 740 |
| Stainless Steel | 7.8 | $>10^{-5}$ | 55 | 460 |
| Silicon (PDMS) | 1.03 | $>10^{14}$ | 0.18 | 1460 |
| Carbon Nanotube | ~1.35 | $\sim10^{-3}\sim10^{-4}$ | >3000 | 700 |
| Nichrome Wire | 8.4 | $1.09 \times 10^{-4}$ | 11.3 | 450 |

To test heating characteristic of the heating layer 313 using the carbon nanotube as the conductive filler, a test sample having an about 1 millimeter (mm) thickness is manufactured by distributing about 0.5 parts by weight of single-layer wall carbon nanotube ("SWCNT")-HiPCo, CNI in silicon rubber ("PDMS", Sylgard® 184, Dow Corning), and a voltage is applied to the sample for the test. As a result of the test, when a power of about 3.9 watts per square centimeter ($W/cm^2$) per unit area is applied, the heat-up time of the heating layer 313 using the carbon nanotube as the conductive filler from room temperature to about 200° C., is about 10 seconds. A power of about 780 W is consumed when the sample is applied to a fixing unit for A4 sized paper. When the thickness of the sample of the heating layer 313 using the carbon nanotube as the conductive filler is reduced to about 200 micrometers (μm), the heat-up from the room temperature to about 200° C. is possible within about 10 seconds with a lower power of about 156 W.

As described above, according to the fixing unit 300 including the heating member 310 using the heating layer 313 in which carbon nanotube is distributed in an elastic material, the heating member 310 may be quickly heated up at a lower consumption power so that the time for printing the first page in the image forming apparatus may be reduced. Also, the consumption power of the image forming apparatus may be reduced by skipping the preheat during the ready mode or lowering the preheat temperature.

Although electric conductivity is improved as the content of the carbon nanotube in the heating layer 313 increases, the elasticity of the elastic material forming the heating layer 313 may be lowered. Also, the mechanical property of the heating layer 313 may be deteriorated. Since the heating layer 313 forms the fixing nip 301 with the press member 320, when the elasticity of the heating layer 313 is deteriorated, it is disadvantageous in forming the fixing nip 301 having a sufficient size for a fixing operation where the toner image is fixed to the medium. Also, the lifespan of the heating layer 313 may be reduced. Thus, there is a demand to realize a relatively large electric conductivity while reducing the content of the carbon nanotube in the heating layer 313, for example, to be not more than about 1 part by weight.

The carbon nanotube used as the conductive filler may be a single-layer wall carbon nanotube ("SWCNT") or a multi-layer wall carbon nanotube ("MWCNT"). In exemplary embodiments, when the SWCNT is used, a relatively higher electric conductivity may be obtained compared to a case of using the MWCNT.

The electric conductivity may be increased by using carbon nanotube doped with metal, such as Ag, as the conductive filler. In exemplary embodiments, under the condition of the same content, the metal doped carbon nanotube has a higher electric conductivity than a pristine carbon nanotube or a functionalized carbon nanotube ("CNT"). In one exemplary embodiment, the heating layer 313, in which MWCNT doped with Ag, and having a diameter of about 10 nanometers (nm) to about 20 nanometers (nm) and a length of about 10 μm to about 50 μm is added by about 0.5 parts by weight, has a very high electric conductivity of about 0.81 siemen per centimeter (S/cm).

In exemplary embodiment, the type of metal in the carbon nanotube doped with metal, is not particularly limited. In exemplary embodiments, the carbon nanotube doped with metal such as Ti, V, Cr, Mn, Fe, Co, Ni, Cu, Zn, Al, In, Au, Pt, Mo, Ta, Zr, W, or Ir, other than Ag, or an alloy thereof, may be used as the conductive filler.

As an aspect ratio (length:diameter) of the carbon nanotube increases, it is easier to form a conductive network in the heating layer 313. Also, the number of contacts between the carbon nanotubes for electric conduction is decreased, so that a large electric conductivity may be obtained for the same content. In one exemplary embodiment, the MWCNT having a length of about 540 μm, a diameter of about 35 nm to about 60 nm, and an aspect ratio of about 1:9000 to about 15400 has a larger electric conductivity than the SWCNT having a length of about 2 μm to about 5 μm, a diameter of about 1.2 nm to about 1.5 nm, and an aspect ratio of about 1:1300 to about 4100, for the same content. In the invention, When the aspect ratio of the carbon nanotube is greater than about 5000:1, a relatively high electric conductivity may be realized, while the content of the carbon nanotube in the heating layer 313 is less than or equal to 1 part by weight.

Figure 3:
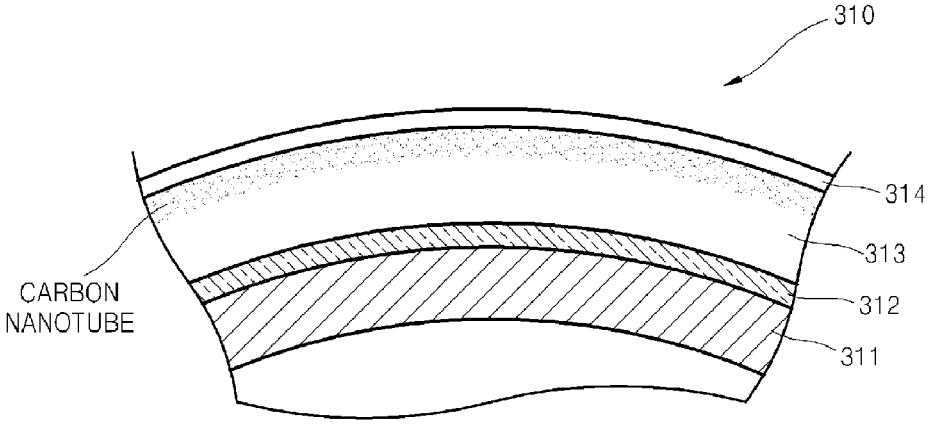
FIG. 3 is a cross-sectional view of an exemplary embodiment of a portion of the fixing unit of FIG. 2.

In order to efficiently supply the heat generated by the carbon nanotube to the fixing nip 301, as illustrated in FIG. 3, the carbon nanotube may be distributed closer to the outer surface layer of the heating layer 313, that is, the outer circumference of the heating member 310, than the core member 311. According to the heating layer 313 configured as in the illustrated embodiment, energy efficiency may be improved because the thermal energy generated from the heating layer 313 is transferred directly to the toner on the paper P without passing through the elastic material forming the heating layer 313 which is closer to the core member 311.

In an exemplary embodiment of a method of manufacturing the heating layer 313 configured as described, for example, a mixture of the elastic material and the carbon nanotube is put into a cylindrical rotational body, and the cylindrical rotational body may be rotated. The carbon nanotube whose specific gravity is greater than that of the elastic material, for example, silicon rubber, is moved toward the outer circumferential side of the cylindrical rotational body due to a centrifugal force. In this method, the heating layer 313 in which the carbon nanotube is distributed close to the outer surface layer thereof, may be manufactured. The heating layer 313 manufactured in the above method may have a thin film tube shape or thin film sheet shape.

In an exemplary embodiment of a method of manufacturing the heating member 310, the heating member 310 may be manufactured by inserting or attaching the heating layer 313 in or to the outer circumferential surface of the core member 311.

Referring to FIGS. 2 and 3, to prevent loss of the heat generated from the heating layer 313 by the core member 311, a heat insulation layer 312 may be provided between the heating layer 313 and the core member 311. The heat insulation layer 312 may be, for example, high heat resistant silicon layer or mica layer. In an alternative embodiment, an insulation layer (not shown) having an electric insulation characteristic may be provided at the inner and outer circumferential sides of the heating layer 313. Since the heat insulation layer 312 is disposed between the core member 311 and the heating layer 313, a portion of the heating member 310 may be heated, except for a remaining portion including the heat insulation layer 312 and the core member 311.

Also, a release layer 314 such as a perfluoroalkoxy copolymer ("PFA") layer may be provided as the outermost surface of the heating member 310. The release layer 314 reduces or effectively prevents attachment of the toner melted by heat to the heating member 310, so that the paper P passing through the fixing nip 301 may be easily separated from the heating member 310. The heat used to fix the toner image to the medium is generated only by the heating layer 313 of the heating member 310, even though the heat may be transferred from the heat-generating heating layer 313 to pass through the release layer 314 while the toner image is being fixed to the medium.

A first (e.g., front) surface of the paper P on which the toner image adheres contacts the heating member 310. A second (e.g., rear) surface of the paper P is contacted and supported by the press member 320. When power is supplied to the heating layer 313, the heating member 310 is heated up to a temperature suitable for the fixing the color toner image on the paper P, for example, from about 150° C. to about 200° C. The toner on the paper P is effectively melted by the thermal energy of the heating layer 313. The melted toner is pressed against the surface of the paper P by a pressure applied by the heating member 310 and the press member 320 being engaged with each other. Accordingly, the toner image is fixed on the front surface of the paper P.

Figure 4:
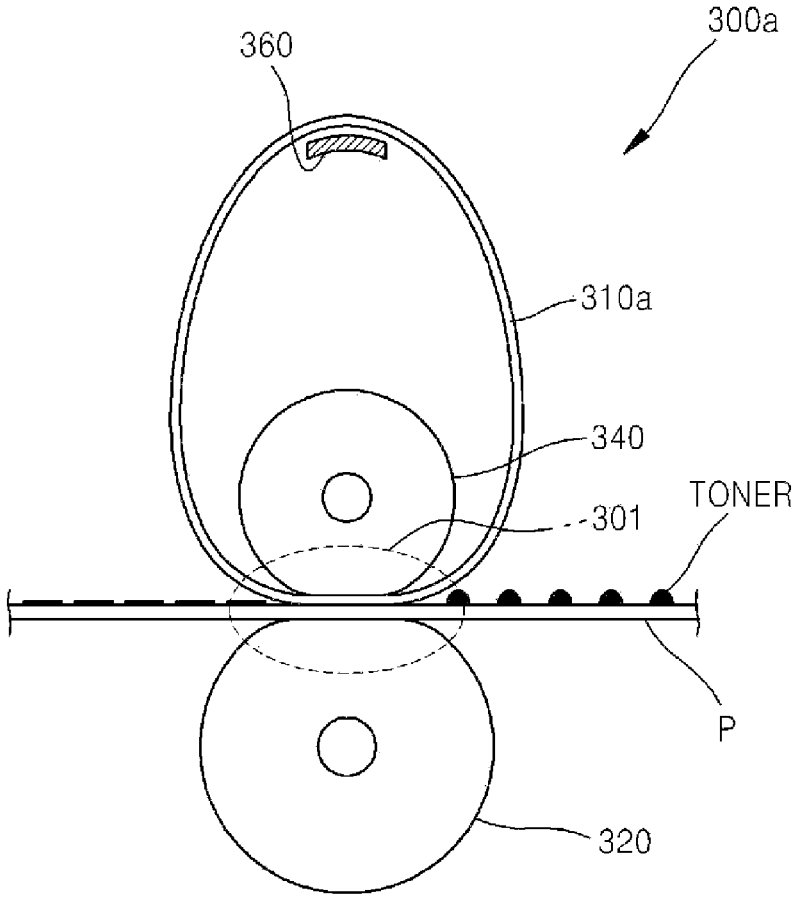
FIG. 4 is a cross-sectional view of an exemplary embodiment of a fixing unit using a belt type fixing member according to the invention.
Figure 5:
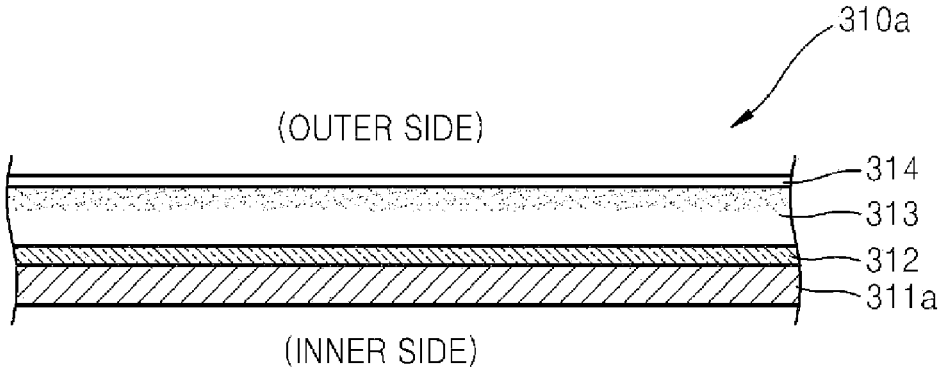
FIG. 5 is a cross-sectional view of the belt type fixing member of FIG. 4.

FIG. 4 is a cross-sectional view of an exemplary embodiment of a fixing unit 300*a* using a belt type fixing member according to the invention. FIG. 5 is a cross-sectional view of the belt type fixing member of FIG. 4. Referring to FIG. 4, the fixing unit 300*a* is different from the fixing unit 300 of FIG. 2 in that a heating member 310*a* includes a core member 311*a* (FIG. 5) having a belt shape. When the heating member 310*a* having the belt shape is applied to the fixing unit 300*a*, the heating member 310*a* is referred to as a fixing belt.

FIG. 4 illustrates the heating member 310*a*, the press (roller) member 320, and a nip forming member 340. The nip forming member 340 is located inside the heating member 310*a* having a belt shape which forms a closed loop. The press member 320 is located outside the heating member 310*a*. To form the fixing nip 301, indicated by the dotted line circle in FIG. 4, the nip forming member 340 and the press member 320 are rotated by being engaged with each other with the heating member 310*a* interposed therebetween. A bias unit (not shown) applies an elastic force to the nip forming member 340 and/or the press member 320 in directions in which the nip forming member 340 and the press member 320 are engaged with each other.

Referring to FIG. 5, the heating member 310*a* includes the core member 311*a* and the heating layer 313 provided outside the core member 311*a*. The core member 311*a* may be a metal thin film, for example, a stainless steel thin film. A thickness of the core member 311*a*, taken perpendicular to the heating member 301*a*, may be determined to have flexibility such that the heating member 310*a* may be flexibly deformed at the fixing nip 301 in a direction of the thickness, and returned to an original thickness and form after passing through the fixing nip 301. In one exemplary embodiment, the core member 311*a* may be a stainless steel thin film having a thickness of about 35 μm. Since the heating member 313 is described in the exemplary embodiment in FIGS. 2 and 3, a detailed description thereof will be omitted herein.

In one exemplary embodiment, the nip forming member 340 is an elastic roller type as illustrated in FIG. 4, and may circulate (e.g., rotate) the heating member 310*a* while rotating with the press member 320. Since the heating member 310*a* is circulated by the nip forming member 340 and the press member 320, which rotate by being engaged with each other, slippage is hardly generated or very small slippage is generated between the nip forming member 340 and the press member 320. Thus, the heating member 310*a* may be stably circulated and moved through the fixing nip 301.

The heating member 310*a* may be circulated in a tensionless state. That is, the heating member 310*a* is circulated by the rotation of the nip forming member 340 and the press member 320. No intentional tension is applied to the overall portion of the heating member 310*a*. A belt guide 360 prevents sagging of the heating member 310*a* and supports the heating member 310*a* to be loose such that tension may not be applied to the heating member 310*a*. In addition, the belt guide 360 may guide a distal end portion of the heating member 310*a* in a widthwise direction (e.g., horizontal in FIG. 4), to reduce or effectively prevent skew of the heating member 310*a*.

Figure 6:
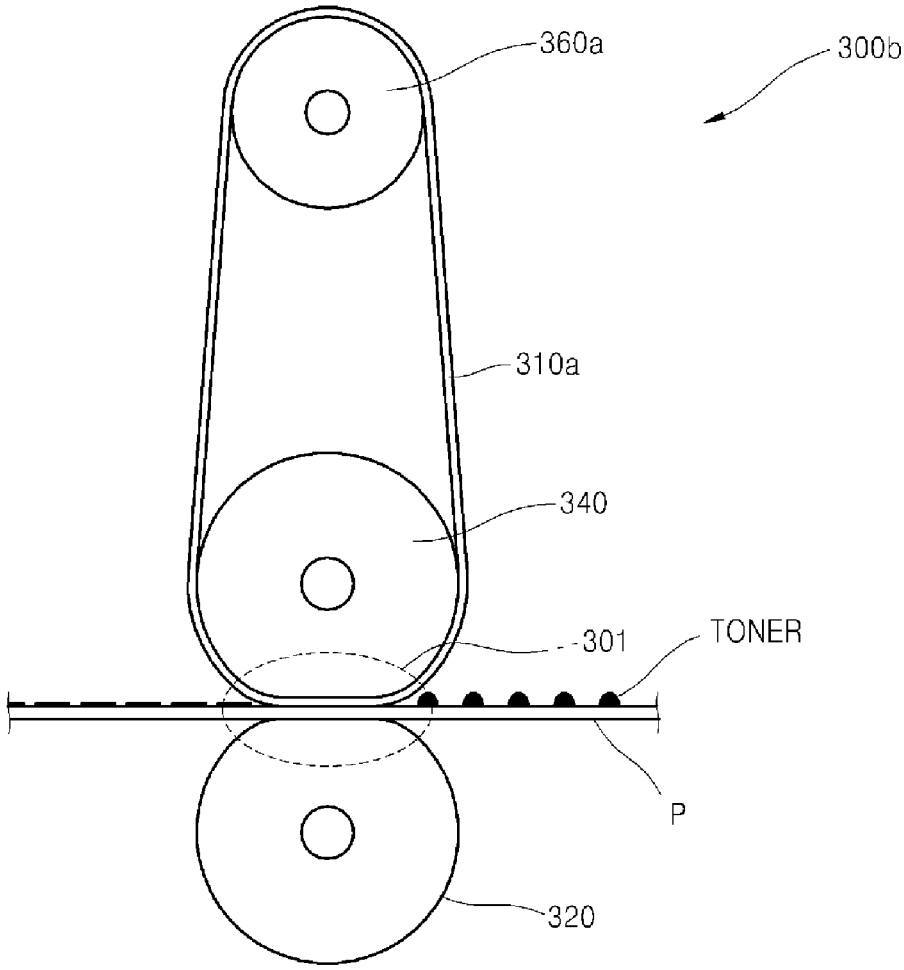
FIG. 6 is a cross-sectional view of another exemplary embodiment of a fixing unit using a belt type fixing member according to the invention.

FIG. 6 is a cross-sectional view of another exemplary embodiment of a fixing unit using a belt type fixing member according to the invention. In a fixing unit 300*b* of FIG. 6, similar to the fixing unit 300*a* in FIGS. 4 and 5, the heating member 310*a* of a belt type may be circulated by being guided by a belt guide 360*a* of a roller type with tension applied.

In the illustrated embodiments, the heating members 310 and 310*a* are described as being applied to the fixing unit of an electrophotographic image forming apparatus. However, the application scope of the heating member is not limited to the fixing unit, such that the heating member may be applied to a variety of apparatuses using a heat source for generating heat using electricity.

It should be understood that the exemplary embodiments described herein should be considered in a descriptive sense only and not for purposes of limitation. Descriptions of features or aspects within each embodiment should typically be considered as available for other similar features or aspects in other embodiments.

What is claimed is:

1. A heating member comprising:

a core member; and a heating layer disposed on an outer circumference of the core member and disposed adjacent to an outer circumference of the heating member, the heating layer comprising:

an elastic material; and carbon nanotubes doped with metal and distributed in the elastic material as a conductive filler of the heating layer, wherein a density of the carbon nanotubes adjacent to an outer surface of the heating layer is higher than a density of the carbon nanotubes adjacent to the core member.

2. The heating member of claim 1, wherein an aspect ratio of length to diameter of the carbon nanotube is not less than 5000:1.

3. The heating member of claim 1, wherein a content of the carbon nanotube in the heating layer is less than 1 part by weight.

4. The heating member of claim 1, further comprising a heat insulation layer which is disposed between the core member and the heating layer.

5. The heating member of claim 1, wherein the core member has a metal hollow pipe shape.

6. The heating member of claim 1, wherein the core member has a flexible belt shape.

7. A fixing unit comprising:
a heating member which comprises:
a core member; and
a heating layer disposed on an outer circumference of the core member and disposed adjacent to an outer circumference of the heating member, the heating layer comprising:
an elastic material; and
carbon nanotubes doped with metal and distributed in the elastic material as a conductive filler of the heating layer,
wherein a density of the carbon nanotubes adjacent to an outer surface of the heating layer is higher than a density of the carbon nanotubes adjacent to the core member; and
a press member facing the heating member to form a fixing nip with the heating member,
wherein the fixing unit applies heat and pressure to toner on a medium passing through the fixing nip to fix the toner on the medium.

8. The fixing unit of claim 7, wherein an aspect ratio of length to diameter of the carbon nanotube is not less than 5000:1.

9. The fixing unit of claim 7, wherein a content of the carbon nanotube in the heating layer is less than 1 part by weight.

10. The fixing unit of claim 7, further comprising a heat insulation layer which is disposed between the core member and the heating layer.

11. The fixing unit of claim 7, wherein the core member has a metal hollow pipe shape.

12. The fixing unit of claim 7, wherein the core member has a flexible belt shape.

13. An electrophotographic image forming apparatus comprising:
a fixing unit receiving a medium including a toner image disposed thereon, and fixing the toner image to the medium, the fixing unit comprising:
a press member; and
a heating member facing the press member and forming a fixing nip with the press member, the heating member comprising:
a core member; and
a heating layer disposed on an outer surface of the core member, and between the outer surface of the core member and an outermost surface of the heating member, the heating layer comprising:
an elastic material; and
carbon nanotube doped with metal and distributed in the elastic material as a conductive filler of the heating layer,
wherein a density of the carbon nanotubes adjacent to an outer surface of the heating layer is higher than a density of the carbon nanotubes adjacent to the core member;
wherein the fixing unit applies heat and pressure to the toner image disposed on the medium, as the medium including the toner image passes through the fixing nip, and fixes the toner image to the medium.

14. The electrophotographic image forming apparatus of claim 13, wherein the heat applied by the fixing unit is generated only from the heating layer of the heating member.

* * * * *